US008555961B2

(12) United States Patent
Koloy et al.

(10) Patent No.: US 8,555,961 B2
(45) Date of Patent: Oct. 15, 2013

(54) SWELLABLE PACKER WITH COMPOSITE MATERIAL END RINGS

(75) Inventors: Tom R. Koloy, Sandnes (NO); Jonny Haugen, Randaberg (NO); David B. Allison, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 675 days.

(21) Appl. No.: 12/348,395

(22) Filed: Jan. 5, 2009

(65) Prior Publication Data

US 2009/0179383 A1 Jul. 16, 2009

(30) Foreign Application Priority Data

Jan. 7, 2008 (WO) ..... PCT/US08/50371

(51) Int. Cl.
*E21B 33/12* (2006.01)

(52) U.S. Cl.
USPC ..... 166/179; 166/387

(58) Field of Classification Search
USPC ..... 166/118, 119, 137, 195, 196, 387, 179
See application file for complete search history.

(56) References Cited

U.S. PATENT DOCUMENTS

| | | | |
|---|---|---|---|
| 2,275,936 | A | 3/1942 | Baker |
| 2,830,540 | A | 4/1958 | Vincent |
| 2,942,666 | A | 6/1960 | True et al. |
| 3,385,367 | A | 5/1968 | Kollsman |
| 4,234,197 | A | 11/1980 | Amancharla |
| 4,375,240 | A | 3/1983 | Baugh et al. |
| 4,971,152 | A | 11/1990 | Koster et al. |
| 5,413,170 | A | 5/1995 | Moore |
| 5,423,383 | A | 6/1995 | Pringle |
| 5,425,420 | A | 6/1995 | Pringle |
| 5,433,269 | A | 7/1995 | Hendrickson |
| 5,465,793 | A | 11/1995 | Pringle |
| 5,488,992 | A | 2/1996 | Pringle |
| 6,009,951 | A | 1/2000 | Coronado et al. |
| 6,318,729 | B1 | 11/2001 | Pitts, Jr. et al. |
| 6,351,985 | B1 | 3/2002 | Bedwell |
| 6,494,496 | B1 | 12/2002 | Sweeney |

(Continued)

FOREIGN PATENT DOCUMENTS

| | | | |
|---|---|---|---|
| CN | 1452686 | A | 10/2003 |
| RU | 2157440 | C2 | 10/2000 |

(Continued)

OTHER PUBLICATIONS

Russian Office Action issued Jan. 11, 2010, for Russian Patent Application Serial No. 2009113625, 2 pages.

(Continued)

*Primary Examiner* — Brad Harcourt
(74) *Attorney, Agent, or Firm* — Smith IP Services, P.C.

(57) ABSTRACT

A swellable packer with composite material end rings. A packer assembly includes at least one generally tubular seal element extending longitudinally between opposite ends thereof. At least one end ring is positioned proximate one of the seal element opposite ends. The end ring includes a non-metal material. A method of constructing a packer assembly includes the steps of: chemically bonding at least one end ring to a base pipe; providing at least one generally tubular seal element which extends longitudinally between opposite ends thereof; and restricting longitudinal displacement of the seal element relative to the base pipe utilizing the end ring positioned at one of its opposite ends.

17 Claims, 2 Drawing Sheets

(56) References Cited

U.S. PATENT DOCUMENTS

| | | | | |
|---|---|---|---|---|
| 6,581,682 | B1 | 6/2003 | Parent et al. | |
| 6,705,615 | B2 | 3/2004 | Milberger et al. | |
| 7,059,415 | B2 | 6/2006 | Bosma et al. | |
| 7,070,001 | B2 | 7/2006 | Whanger et al. | |
| 7,121,352 | B2 | 10/2006 | Cook et al. | |
| 7,124,831 | B2 | 10/2006 | Turley et al. | |
| 7,152,684 | B2 | 12/2006 | Harrall et al. | |
| 7,195,730 | B2 | 3/2007 | Calderoni et al. | |
| 7,228,915 | B2 | 6/2007 | Thomson | |
| 7,422,071 | B2 | 9/2008 | Wilkie et al. | |
| 7,690,437 | B2 | 4/2010 | Guillot et al. | |
| 7,762,344 | B2 | 7/2010 | Courville et al. | |
| 8,006,773 | B2 | 8/2011 | Courville et al. | |
| 2004/0020662 | A1 | 2/2004 | Freyer | |
| 2005/0092485 | A1* | 5/2005 | Brezinski et al. | 166/207 |
| 2005/0171248 | A1 | 8/2005 | Li et al. | |
| 2005/0199401 | A1 | 9/2005 | Patel et al. | |
| 2006/0272806 | A1 | 12/2006 | Wilkie et al. | |
| 2007/0012436 | A1 | 1/2007 | Freyer | |
| 2007/0131414 | A1 | 6/2007 | Calderoni | |
| 2007/0151724 | A1 | 7/2007 | Ohmer et al. | |
| 2007/0221387 | A1 | 9/2007 | Levy | |
| 2008/0078561 | A1 | 4/2008 | Chalker | |
| 2008/0093086 | A1 | 4/2008 | Courville et al. | |
| 2008/0135260 | A1* | 6/2008 | Berzin et al. | 166/380 |
| 2008/0185158 | A1 | 8/2008 | Chalker et al. | |
| 2008/0308283 | A1 | 12/2008 | Freyer | |
| 2009/0044957 | A1* | 2/2009 | Clayton et al. | 166/387 |
| 2009/0139707 | A1* | 6/2009 | Berzin et al. | 166/118 |
| 2009/0211770 | A1 | 8/2009 | Nutley et al. | |
| 2012/0067565 | A1 | 3/2012 | Chalker et al. | |

FOREIGN PATENT DOCUMENTS

| | | | |
|---|---|---|---|
| WO | 2004015238 | A1 | 2/2004 |
| WO | 2005090741 | A1 | 9/2005 |
| WO | 2005116394 | A1 | 12/2005 |
| WO | 2006118470 | A1 | 11/2006 |
| WO | 2008033115 | A1 | 3/2008 |

OTHER PUBLICATIONS

English Translation of Russian Office Action issued Jan. 11, 2010, for Russian Patent Application Serial No. 2009113625, 2 pages.
Protech Centerform Integral Bow Spring Centralizer webpage, 2006, 3 pages.
Protech Centerform Case Histories webpage, 2006, 3 pages.
Protech Centerform Carbon Fiber Composite Centralizers webpage, 2006, 2 pages.
International Search Report and Written Opinion issued Jun. 27, 2008, for International Patent Application Serial No. PCT/US08/50371, 7 pages.
International Search Report and Written Opinion issued Mar. 21, 2008, for International Patent Application Serial No. PCT/US07/61703, 7 pages.
Salamy, S.P., Al-Mubarak, H.K., Hembling, D.E., and Al-Ghamdi, M.S., Deployed Smart Technologies Enablers for Improving Well Performance in Tight Reservoirs, SPE 99281, Apr. 11-13, 2006, 6 pages, Amsterdam.
Jennings, Iain, Enhancing Production Using Solid Expandable Tubulars in Workover Campaigns, SPE 107624, Apr. 16-18, 2007, 5 pages, Denver, Colorado.
Kleverlaan, M., Van Noort, R. H., Jones, I., Deployment of Swelling Elastomer Packers in Shell E&P, SPE 92346, Feb. 23-25, 2005, 5 pages, Amsterdam.
Halliburton Swellpacker® Cable System Product Brochure, 2008, 2 pages.
Office Action issued Mar. 16, 2011, for U.S. Appl. No. 12/016,660, 8 pages.
International Preliminary Report on Patentability issued Mar. 26, 2009, for International Patent Application Serial No. PCT/US07/35052, 5 pages.
Office Action issued Apr. 15, 2010, for U.S. Appl. No. 11/852,295, 7 pages.
Office Action issued Jun. 16, 2010, for U.S. Appl. No. 12/016,600, 47 pages.
Office Action issued Jun. 30, 2011 for U.S. Appl. No. 12/016,600, 13 pages.
Chinese Office Action issued Jul. 6, 2011 for CN Patent Application No. 200680055799.8, 7 pages.
International Preliminary Report on Patentability with Written Opinion issued Aug. 20, 2009, for International Patent Application Serial No. PCT/US07/61703, 7 pages.
Office Action issued Oct. 28, 2009, for U.S. Appl. No. 11/875,779, 18 pages.
Final Office Action issued Nov. 5, 2010, for U.S. Appl. No. 12/016,600, 10 pages.
Office Action issued Nov. 9, 2010, for U.S. Appl. No. 12/615,335, 17 pages.
Office Action issued Dec. 3, 2009, for U.S. Appl. No. 11/852,295, 10 pages.
Office Action issued Jun. 22, 2009, for U.S. Appl. No. 11/852,295, 16 pages.
Office Action issued Jan. 31, 2012 for U.S. Appl. No. 12/016,600, 8 pages.
Office Action issued Apr. 9, 2012 for U.S. Appl. No. 13/303,477, 25 pages.
Office Action issued Jul. 3, 2012 for U.S. Appl. No. 12/016,600, 13 pages.
Office Action issued Sep. 10, 2012 for U.S. Appl. No. 13/303,477, 9 pages.
Advisory Action issued Sep. 14, 2012 for U.S. Appl. No. 12/016,600, 7 pages.
Office Action issued Nov. 6, 2012 for U.S. Appl. No. 12/016,600, 13 pages.
Advisory Action issued Dec. 10, 2012 for U.S. Appl. No. 13/303,477, 23 pages.
Examiner's Answer issued Apr. 25, 2013 for U.S. Appl. No. 13/303,477, 5 pages.

* cited by examiner

SWELLABLE PACKER WITH COMPOSITE MATERIAL END RINGS

CROSS-REFERENCE TO RELATED APPLICATION

The present application claims the benefit under 35 USC §119 of the filing date of International Application No. PCT/US08/50371, filed Jan. 7, 2008. The entire disclosure of this prior application is incorporated herein by this reference.

BACKGROUND

The present invention relates generally to annular barriers and packer assemblies and, in an embodiment described herein, more particularly provides a swellable packer with composite material end rings.

It is known to provide packers with metal end rings straddling a seal element. However, this method of construction generally requires that the seal element and end rings be separately assembled onto a base pipe of a packer. Furthermore, metal end rings may not have the most desirable friction characteristics when conveying the packer into a well.

Where metal end rings are used, they are typically attached to the base pipe by welding, securing with set screws, swaging, etc. These methods can be time-consuming and, thus, costly in the manufacturing process.

It will, therefore, be appreciated that improvements are needed in the art of constructing packers.

SUMMARY

In the present specification, packer assemblies and associated methods are provided which solve at least one problem in the art. One example is described below in which end rings and a centralizer ring can be molded onto a base pipe to thereby save time in the manufacturing process. Another example is described below in which the friction-reducing and strength benefits of composite materials are utilized.

In one aspect, a packer assembly is provided. The packer assembly comprises at least one generally tubular seal element extending longitudinally between opposite ends thereof. At least one end ring is positioned proximate one of the seal element opposite ends. The end ring includes a nonmetal material.

In another aspect, a method of constructing a packer assembly is provided. The method includes the steps of: providing at least one generally tubular seal element which extends longitudinally between opposite ends thereof; providing at least one end ring comprising a nonmetal material; and restricting longitudinal displacement of the seal element utilizing the end ring positioned at one of its opposite ends.

In yet another aspect, a method of constructing a packer assembly includes the steps of: chemically bonding at least one end ring to a base pipe; providing at least one generally tubular seal element which extends longitudinally between opposite ends thereof; and restricting longitudinal displacement of the seal element relative to the base pipe utilizing the end ring positioned at one of the opposite ends.

These and other features, advantages, benefits and objects will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
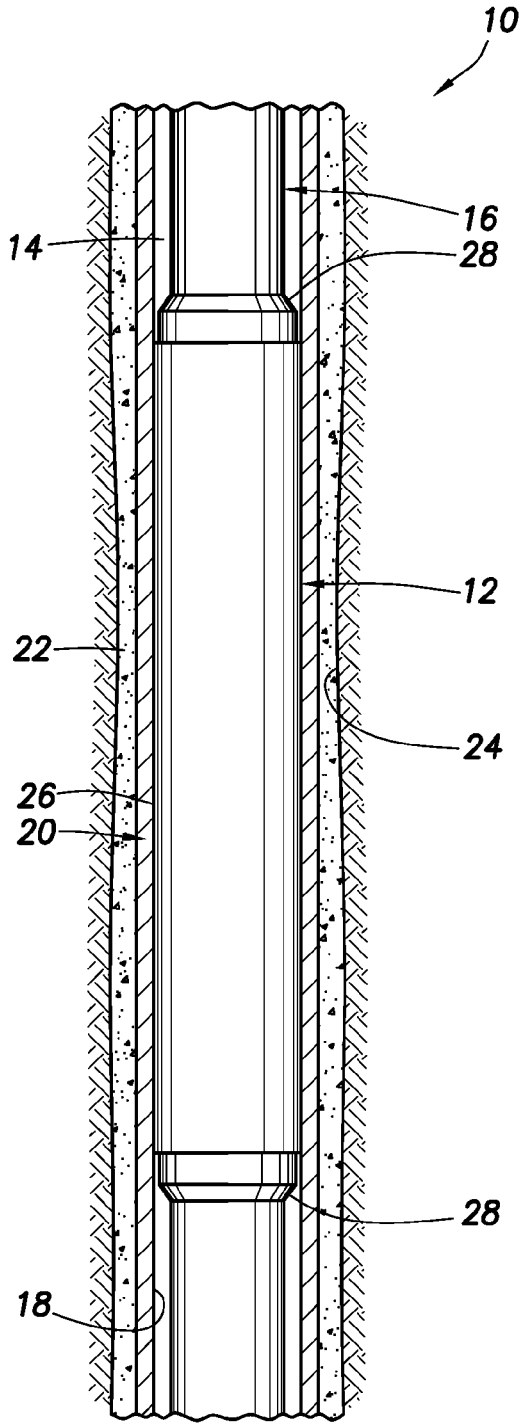
FIG. 1 is a partially cross-sectional view of a well system embodying principles of the present invention.

Representatively illustrated in FIG. 1 is a well system 10 which embodies principles of the present invention. In the system 10, a packer assembly 12 is used to provide a fluid and pressure barrier in an annulus 14 formed between a tubular string 16 and a wellbore interior surface 18. Although the surface 18 is depicted in FIG. 1 as being formed on an interior of a casing, liner or other type of tubular string 20 which is encased in cement 22, the surface could instead be formed on an interior wall of a formation 24 (for example, in an uncased portion of the well), or could be any other surface in the well.

The packer assembly 12 includes a seal element 26 which is outwardly extended in order to sealingly engage the surface 18. In the illustrated example, the seal element 26 includes a swellable material which swells in response to contact with a certain fluid in the well.

The term "swell" and similar terms (such as "swellable") are used herein to indicate an increase in volume of a seal material. Typically, this increase in volume is due to incorporation of molecular components of the fluid into the seal material itself, but other swelling mechanisms or techniques may be used, if desired.

When the seal material swells in the well system 10, it expands radially outward into contact with the inner surface 18 of the tubular string 20, or an inner surface of the formation 24. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The fluid which causes swelling of the swellable material could be water and/or hydrocarbon fluid (such as oil or gas). The fluid could be a gel or a semi-solid material, such as a hydrocarbon-containing wax or paraffin which melts when exposed to increased temperature in a wellbore. In this manner, swelling of the material could be delayed until the material is positioned downhole where a predetermined elevated temperature exists. The fluid could cause swelling of the swellable material due to passage of time.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

The swellable material may have a considerable portion of cavities which are compressed or collapsed at the surface condition. Then, when being placed in the well at a higher pressure, the material is expanded by the cavities filling with fluid.

This type of apparatus and method might be used where it is desired to expand the material in the presence of gas rather than oil or water. A suitable swellable material is described in International Application No. PCT/NO2005/000170 (published as WO 2005/116394), the entire disclosure of which is incorporated herein by this reference.

It should, thus, be clearly understood that any swellable material which swells when contacted by any type of fluid may be used in keeping with the principles of the invention. It should also be understood that it is not necessary for a seal material to swell in a packer assembly incorporating principles of the invention. A seal material could alternatively, or in addition, be inflated, compressed, or extended in any other manner, in keeping with the principles of the invention.

The seal element 26 is restricted from displacing longitudinally in the annulus 14 by means of end rings 28 positioned at opposite ends of the seal element. The end rings 28 can perform any of several beneficial functions in the packer assembly 12. For example, the end rings 28 can prevent or reduce relative displacement of the seal element 26 and tubular string 16, prevent or reduce extrusion of the seal element past the end rings in the annulus 14, reduce friction between the packer assembly 12 and the interior surface 18 during conveyance of the packer assembly into the well, etc.

In one example of the packer assembly 12 construction, the end rings 28 include, or are made entirely of, a composite material. In another example, the end rings 28 are molded directly onto the packer assembly 12. In yet another example, the end rings 28 are separately formed, and then incorporated into the packer assembly 12.

As used herein, the term "composite material" indicates a material which is made up of a mixture of different materials, with the result that each of the materials contributes beneficially to the properties of the composite material. One example is a composite material made up of fibrous material (such as glass or carbon fibers, etc.) in a hardenable matrix (such as a polymer material, etc.). A composite material may be a nonmetal material.

Figure 2:
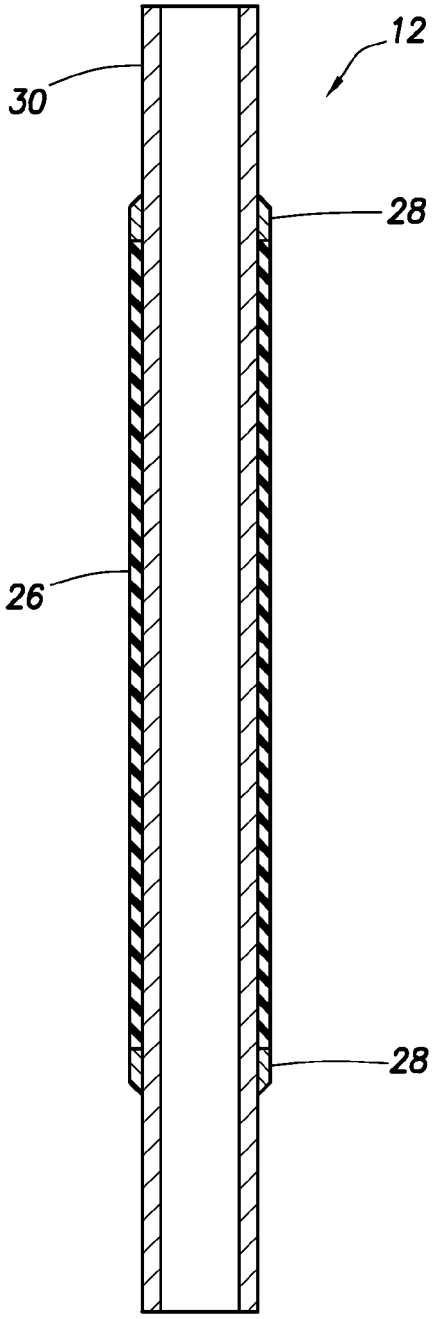
FIG. 2 is an enlarged scale cross-sectional view of a packer assembly embodying principles of the invention.

Referring additionally now to FIG. 2, a schematic cross-sectional view of the packer assembly 12 is representatively illustrated apart from the remainder of the well system 10. This figure depicts one construction of the packer assembly 12, but it should be understood that the principles of the invention are not limited at all by the details of the packer assembly described below.

In one method of constructing the packer assembly 12, the end rings 28 are molded onto a tubular base pipe 30. In the well system 10, the base pipe 30 could be provided with suitable threaded end connections, and could be interconnected as a part of the tubular string 16. The packer assembly 12 could alternatively be used in other well systems, without departing from the principles of the invention.

In one embodiment, the base pipe 30 could be made of a metal material (such as a steel), and the end rings 28 could be made of a composite material which is molded onto the metal base pipe (for example, after mechanically or chemically cleaning and preparing an outer surface of the base pipe). In another embodiment, the base pipe 30 and end rings 28 could both be made of a composite material, and could be integrally formed as a single structure.

The seal element 26 can also be molded onto the base pipe 30. The seal element 26 could, for example, be molded onto the base pipe 30 either before or after the end rings 28 are molded onto the base pipe. Of course, if the seal element 26 is not intended to extend as a result of swelling in the well, then the seal element preferably would not be molded onto the base pipe 30.

In one embodiment, the seal element 26 is adhesively bonded onto the base pipe 30. In another embodiment, the seal element 26 is not bonded onto the base pipe 30. In this latter case, the end rings 28 can function to prevent slippage of the seal element 26 relative to the base pipe 30 during and after conveyance of the packer assembly 12 into the well.

The seal element 26 is depicted in FIG. 2 as having substantially the same outer diameter as the end rings 28, but other configurations may be used if desired. For example, the seal element 26 could initially have a smaller outer diameter than the end rings 28 (e.g., for protection of the seal element during conveyance into the well), or the seal element could initially have a larger outer diameter than the end rings (e.g., to provide more seal material volume).

The end rings 28 may have any shape. For example, the end rings 28 may be segmented or fluted. The shape of the end rings 28 can be conveniently tailored to specific well circumstances, for example, by changing their length, profile, etc.

The end rings 28 may include a material, such as a composite material, polymer, etc., which reduces friction between the packer assembly 12 and interior surfaces of the well across which the packer assembly traverses as it is being conveyed into the well. The end rings 28 can also serve to protect the seal element 26 during conveyance of the packer assembly 12 into the well, as discussed above.

Figure 3:
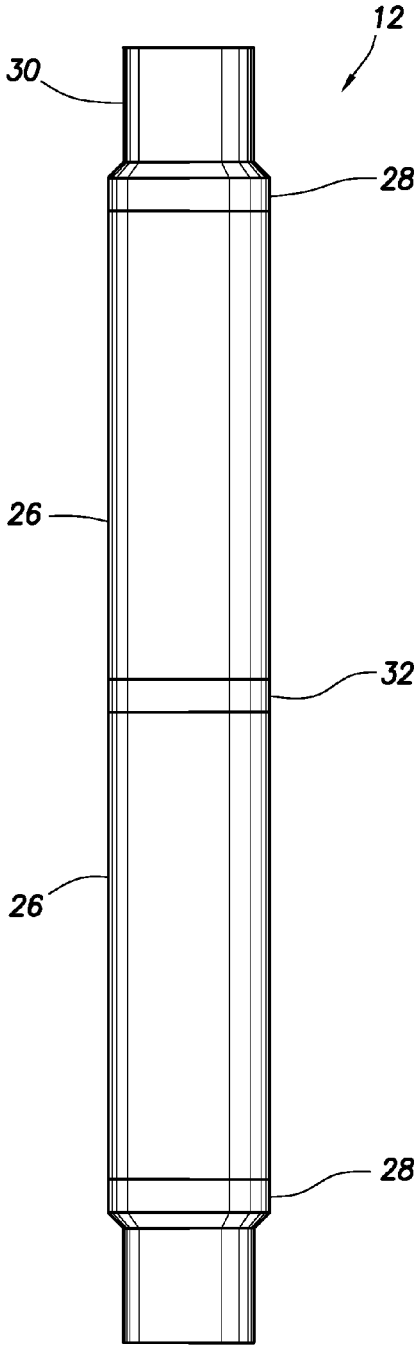
FIG. 3 is an elevational view of an alternate construction of the packer assembly.

Referring additionally now to FIG. 3, an elevational view of an alternate construction of the packer assembly 12 is representatively illustrated. In this configuration, two seal elements 26 are utilized, with a centralizer ring 32 provided between the seal elements.

The end rings 28 still straddle the seal elements 26, but the centralizer ring 32 provides further friction reduction, protection of the seal elements and centralization of the seal elements in the packer assembly 12. The benefits of the centralizer ring 32 are especially suited for situations in which the packer assembly 12 is very long.

The centralizer ring 32 may include, or be entirely made of, a composite material. The centralizer ring 32 may be molded onto the base pipe 30, or it may be separately formed and attached to the base pipe.

The centralizer ring 32 may be made of the same material as the end rings 28, and may be molded onto the base pipe 30 at the same time as the end rings are molded onto the base pipe. The centralizer ring 32 may be molded onto the base pipe 30 before or after the seal elements 26 or end rings 28 are molded onto the base pipe.

It is anticipated that enhanced strength of attachment between the end rings 28 and/or centralizer ring 32 and the base pipe 30 will be achieved due to molding the end rings and/or centralizer ring directly onto the base pipe. If further increased strength is desired, the lengths of the end rings 28 and/or centralizer ring 32 could be increased (to thereby increase the contact surface area between these elements and the base pipe 30), and/or the exterior surface of the base pipe could be provided with a roughened texture, grooves, knurling, etc., to thereby increase the shear strength of the bond between the base pipe and the end rings and/or centralizer ring.

Although one centralizer ring 32 is depicted in FIG. 3 as being positioned between two of the seal elements 26, it will be appreciated that any number of these elements could be utilized, as desired. For example, two centralizer rings 32 could be used alternately with three seal elements 26 along the base pipe 30, etc.

Figure 4:
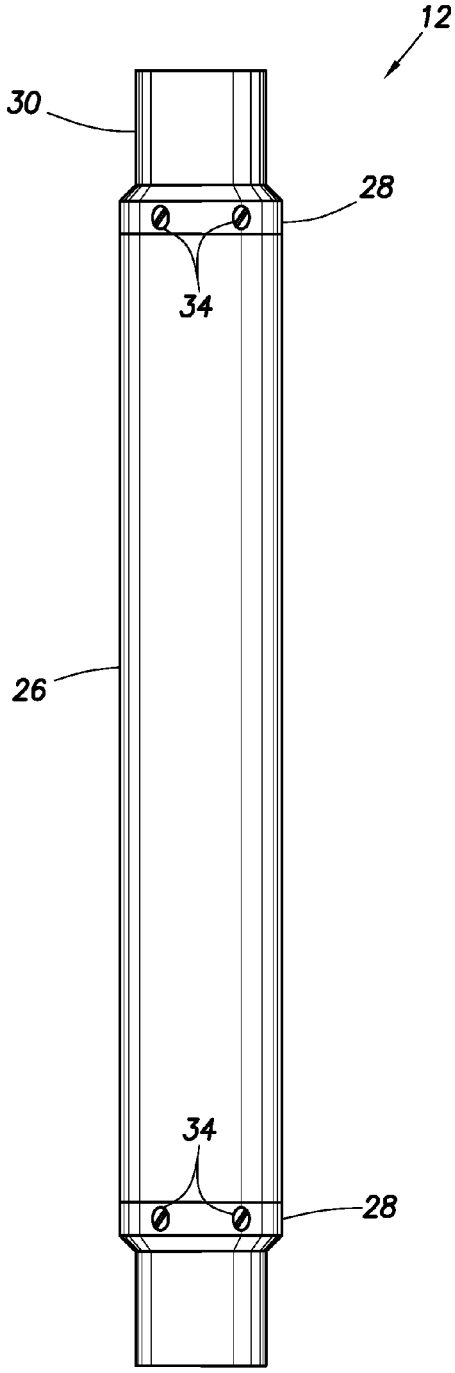
FIG. 4 is an elevational view of another alternate construction of the packer assembly.

Referring additionally now to FIG. 4, another alternate construction of the packer assembly 12 is representatively illustrated. In this configuration, the seal element 26 is separately formed from the remainder of the packer assembly 12, and is then slipped onto the base pipe 30 from an end thereof.

Alternatively, the seal element 26 could be longitudinally split, and then wrapped on the base pipe 30 from a side thereof. As another alternative, the seal element 26 could be wrapped helically about the base pipe 30. In any of these alternatives, the seal element 26 could be secured to the base pipe 30 using, for example, an adhesive. Any method of positioning the seal element 26 on the base pipe 30, and any method of securing the seal element to the base pipe, may be used in keeping with the principles of the invention.

The end rings 28 in the example of FIG. 4 are secured to the base pipe 30 at opposite ends of the seal element 26 by means of set screws 34 which extend through the end rings and grip an outer surface of the base pipe. However, any method of attaching the end rings 28 to the base pipe 30 may be used in keeping with the principles of the invention.

Although securing the end rings 28 to the base pipe 30 using the set screws 34 may not take advantage of the benefits of molding the end rings onto the base pipe, the packer assembly 12 can still take advantage of the benefits of utilizing composite material, low friction material, nonmetal material, etc. in the end rings.

One or more centralizer rings 32 may be used in the packer assembly 12 of FIG. 4, if desired. Any number of centralizer rings 32 and seal elements 26 may be used in the packer assembly 12. The centralizer ring(s) 32 in the embodiments of FIGS. 3 & 4 may be secured to the base pipe 30 using fasteners (such as set screws 34) if desired.

In the embodiments of FIGS. 2 & 3, the end rings 28 (and centralizer ring 32 if used) are preferably chemically bonded to the base pipe 30 as a result of the molding process, instead of being fastened onto the base pipe. In this manner, the end rings 28 are rigidly secured against displacement relative to the base pipe 30, without the disadvantages of mechanically fastening or welding the end rings to the base pipe.

In each of the embodiments described above, the end rings 28 (and centralizer ring 32 if used) may comprise any nonmetal material. The end rings 28 and/or centralizer ring 32 could be made of composite material or other types of materials, such as elastomers.

It may now be fully appreciated that the above description provides several advancements in the art of packer construction. These advancements include, but are not limited to, ease and economy of construction (e.g., eliminating any need to cut grooves into the base pipe, swage end rings onto the base pipe or weld end rings onto the base pipe, etc.), improved performance, adaptability to different types of packer assemblies (such as swellable, inflatable, compressible, etc. types), increased differential pressure ratings, increased axial load ratings, and reduced deterioration of base pipes (e.g., due to fasteners used to attach end rings to the base pipes causing galvanic corrosion, rusting, removal of material, stress induced corrosion, other types of accelerated corrosion, etc.).

More specifically, a packer assembly 12 is provided which includes at least one generally tubular seal element 26 extending longitudinally between opposite ends thereof. At least one end ring 28 is positioned proximate one of the seal element 26 opposite ends. The end ring 28 includes a nonmetal material.

The seal element 26 and end ring 28 may circumscribe a base pipe 30. The end ring 28 may be molded onto the base pipe 30. The seal element 26 may be molded onto the base pipe 30.

The seal element 26 may include a swellable material. The swellable material may swell in response to contact with a predetermined fluid in a well.

The nonmetal material may include a composite material. The composite material may include a fibrous material in a hardenable polymer matrix.

The packer assembly 12 may also include a centralizer ring 32 positioned between two of the seal elements 26. The centralizer ring 32 may include a nonmetal material. The nonmetal material may include a composite material. The centralizer ring 32 may be molded onto a base pipe 30.

A method of constructing a packer assembly 12 is also provided. The method may include the steps of: providing at least one generally tubular seal element 26 which extends longitudinally between opposite ends thereof; providing at least one end ring 28 comprising a composite material; and restricting longitudinal displacement of the seal element 26 utilizing the end ring 28 positioned at one of the opposite ends.

The seal element 26 providing step may include molding the seal element onto a base pipe 30. The end ring 28 providing step may include molding the end ring onto the base pipe 30.

The restricting step may include straddling the seal element 26 with two of the end rings 28.

The method may include the step of positioning a centralizer ring 32 between two of the seal elements 26, with the centralizer ring comprising a composite material. The composite material may include a nonmetal material.

The seal element 26 providing step may include molding the seal element onto a base pipe 30, the end ring 28 providing step may include molding the end ring onto the base pipe, and the centralizer ring 32 positioning step may include molding the centralizer ring onto the base pipe.

The seal element 26 may include a swellable material. The composite material may include a nonmetal material. The composite material may include a fibrous material in a hardenable polymer matrix.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A packer assembly, comprising:

a base pipe;

two end rings molded onto the base pipe, the end rings comprising a first composite material; and at least one swellable seal element molded onto the base pipe between the end rings, wherein the end rings at least partially define a molding volume of the swellable seal element, wherein the end rings do not displace relative to the base pipe when the seal element swells, thereby retaining the seal element axially in place on the base pipe, and wherein each of the end rings includes on a side opposite the seal element a profile which facilitates conveyance of the packer assembly in a well.

2. The packer assembly of claim 1, wherein the end rings are chemically bonded to the base pipe.

3. The packer assembly of claim 1, wherein the seal element swells in response to contact with a predetermined fluid in the well.

4. The packer assembly of claim 1, wherein the first composite material comprises a fibrous material in a hardenable polymer matrix.

5. The packer assembly of claim 1, wherein the first composite material includes a low friction material.

6. The packer assembly of claim 1, further comprising a centralizer ring positioned between two of the seal elements, the centralizer ring comprising a nonmetal material.

7. The packer assembly of claim 6, wherein the nonmetal material comprises a second composite material.

8. The packer assembly of claim 6, wherein the centralizer ring is molded onto the base pipe.

9. A method of constructing a packer assembly, the method comprising the steps of:

molding two end rings onto a base pipe, the end rings comprising a first composite material; and then positioning at least one swellable seal element on the base pipe between the end rings, wherein the end rings do not displace relative to the base pipe when the seal element swells, thereby retaining the seal element axially in place on the base pipe, and wherein each of the end rings includes on a side opposite the seal element a profile which facilitates conveyance of the packer assembly in a well.

10. The method of claim 9, wherein the seal element positioning step further comprises molding the seal element onto the base pipe.

11. The method of claim 9, further comprising the step of positioning a centralizer ring between two of the seal elements, the centralizer ring comprising a nonmetal material.

12. The method of claim 11, wherein the nonmetal material comprises a second composite material.

13. The method of claim 11, wherein the centralizer ring positioning step further comprises molding the centralizer ring onto the base pipe.

14. The method of claim 9, wherein the seal element swells in response to contact with a predetermined fluid in the well.

15. The method of claim 9, wherein the first composite material comprises a fibrous material in a hardenable polymer matrix.

16. The method of claim 9, wherein the molding step further comprises chemically bonding the end rings to the base pipe.

17. The method of claim 9, wherein the first composite material includes a low friction material.

* * * * *